United States Patent [19]

Eschard et al.

[11] 4,025,813

[45] May 24, 1977

[54] MICROCHANNEL PLATE COMPRISING MICROCHANNELS CURVED ON THE OUTPUT SIDE

[75] Inventors: Gilbert Eschard; Valere Dominique Louis Duchënois, both of Paris; Remy Henri Francois Polaert, Villecresnes, all of France

[73] Assignee: U.S. Philips Corporation, New York, N.Y.

[22] Filed: Feb. 10, 1975

[21] Appl. No.: 548,416

[30] Foreign Application Priority Data

Feb. 13, 1974 France ..... 74.04823

[52] U.S. Cl. ..... 313/105 CM; 313/95

[51] Int. Cl.[2] ..... H01J 43/22; H01J 43/24

[58] Field of Search ..... 313/105 CM

[56] References Cited

UNITED STATES PATENTS 3,497,759 2/1970 Manley ..... 313/105 CM X 3,808,494 4/1974 Hayashi et al. ..... 313/105 CM 3,838,996 10/1974 Polaert et al. ..... 313/105 CM X

*Primary Examiner*—Robert Segal

*Attorney, Agent, or Firm*—Frank R. Trifari; Ronald L. Drumheller

[57] ABSTRACT

The invention relates to secondary-emissive microchannels which are bent to a given extent on the output side of the electrons. The said bending serves to restrict the areas where the electrons contact the channel walls to a small zone at the end of the electron multiplication and before the departure of the secondary electrons. The energy of the output electrons is thus dispersed very little.

The emission of electrons can then be controlled by means of low electrical voltages which can be readily switched. The said partially curved microchannels are incorporated in electron tubes in the advantage of the ease of control, is utilized.

1 Claim, 13 Drawing Figures

MICROCHANNEL PLATE COMPRISING MICROCHANNELS CURVED ON THE OUTPUT SIDE

The invention relates to secondary-emissive microchannel plates having microchannels which are curved on the output side. The invention furthermore relates to a method of manufacturing such microchannel plates and to the use thereof in electronic devices.

It is known that a substantial dispersion occurs in the energy of the output electrons of a microchannel having secondary emission, or of a plate comprising a large number of such microchannels.

As is explained in numerous publications, the said dispersion of energy is due to the combined effect of a plurality of factors (for example, see the publication "Acta Electronica", Volume 14, No. 1, page 79 and further, Jan. 14, 1971, article by A. J. Gerst).

A given, be it weak dispersion occurs on the one hand in the energy of the electrons which are formed, via secondary emission, due to a collision with the wall of the microchannels; on the other hand, however, the secondary electrons which cause these collisions are distributed over a wide energy spectrum; this is related to the fact that the angles of the incidence of the secondary electrons are not the same for all electrons involved in the multiplication process, and also to the fact that the energy of the emitted secondary electrons is dependent of the said angles of incidence. This dispersion is stimulated by the cylindrical shape of the microchannels which is the cause that, after a collision, the secondary electrons emitted in a plurality of directions impinge on the wall at different angles of incidence.

The energy distribution and the angular distribution of the electrons departing from a microchannel plate are very important for the use of such plates. Particularly, if the said microchannel plate is used in an image intensified tube in conjunction with a luminescent screen, the angular dispersion on the one hand causes a broadening of the target of a point on the screen. The said broadening decreases the resolution of the imaging devices. On the other hand, the energy dispersion of the output electrons can have a disturbing effect when the microchannel plate is used as an element whose electron flow is to be globally or locally blocked or deblocked by means of a comparatively small control voltage. In order to ensure easy switching over, a voltage of a few tens of volts is desirable. However, the output electrons often exhibit an energy dispersion of several hundreds of electron volts.

These microchannel plates can be distinguished according to operation in the linear region and operation in the saturation region.

It is known that during operation in the linear region, besides the energy dispersion of the electrons, a further type of dispersion occurs which is closely related to energy dispersion, i.e. a dispersion in the amplitude of the electrical pulses detected on the output of the microchannel plate and corresponding to input electrons having the same energy level. This amplitude dispersion corresponds to amplification factor variations of the microchannel plate which are due to the fact that the electronic multiplication in a channel is a succession of unstable phenomena.

These amplification factor variations can be demonstrated by what is usually referred to as the spectrum of the unique electron (S U E). In a relevant characteristic curve the amplification factor is plotted along the horizontal axis, and the number of pulses is plotted along the vertical axis. A bellshaped curve then arises which is wider as the dispersion is larger.

It is known that the width of the spectrum decreases, i.e. the amplification factor variation decreases, as the operation of the microchannel plate approaches the saturation region. This region corresponds to a strong secondary emission in the longitudinal direction of the wall, the said emission being exhausted at the output of the microchannel, thus giving rise to a positive charge on the output of the microchannels which causes a sudden reduction of the electrical field towards the output and also the termination of electron multiplication.

The amplification factor as well as the overall output charge are thus reduced, independent of the nature of the input electron which gave rise to the said amplification.

This operating region is used for detecting and counting energy quanta or charge quanta. To this end, high electrical voltages must be applied between the ends of the microchannels, for example, voltages of 1500 volts for a length of the channels of approximately 2 mm; this involves given drawbacks. On the one hand, the application of such electrical voltages causes substantial energy dissipation in the walls of the microchannels due to the Joule effect arising from the large electrical current. On the other hand, the said strong electrical field may give rise to the emission of electrons which are torn off the walls and which, after multiplication, may form parasitic signals on the output.

It is also known that in the saturation region the microchannels are more susceptible to ion feedback phenomena due to the intensity of the electrical field within the channel.

The invention proposes to mitigate the described drawbacks.

It is a first object of the invention to reduce the spectrum of the electrons departing from the output side.

It is a second object of the invention to obtain the saturation region at smaller amplification factors and lower electrical voltages.

To this end, the invention takes into account the nature of the secondary multipication processes which cause the dispersion of the energy of the electrons on the output of the microchannel plate or which give rise to the saturation region.

Therefore, the invention proposes to concentrate all locations of incidence of the secondary electrons at the end of the multiplication in a zone of comparatively small surface area.

By the said concentration, the two described objects are simultaneously achieved, i.e.:

on the one hand, due to the fact the the locations of incidence of the secondary electrons are localized at the end of the multiplication, the electrons obtained on the output side are no longer subject to the same energy dispersion as caused by a large variety of points of incidence at the end of the multiplication which are distributed over the entire circumference of the wall, and on the other hand, due to the fact that at the end of the multiplication the locations of incidence of the electrons are localized in a zone having a smaller surface area, the accumulation of the positive charge appearing in well-known saturation region now occurs in the vicinity of the said zone. Considering the fact that the localization of the said positive charged is effected in a zone having a surface area which is smaller than usual, it is thus achieved that saturation is obtained by means of low electrical voltages, so also by means of amplification factors which are smaller than required for the said already known technique.

The invention precisizes the shape of this microchannel type or of a microchannel plate, and also proposes a method of manufacturing these devices. The invention precisizes the bending of the microchannels on the output side, so that the secondary electrons are forced to collide with the wall in a wall zone having a small surface area which is situated on the last curved portion of the curved channel; this takes place independent of the electron and of the processes which gave rise to the formation of the said wall zone and which have their effect before the multiplication takes place at the area of the curved channel portion.

The proposed manufacturing method constitutes an improvement of the method described in French Patent Application No. 2,168,861.

The invention proposes the use of these devices when an electron source is required which has a large emissive surface which emits electrons having low energy levels and little dispersion and which, consequently, can be readily controlled by means of a comparatively low and readily switchable voltage.

The invention essentially implies the adjustment of a secondary-emissive channel electrode comprising at least one microchannel, the inner surfaces of the said microchannels having a secondary emission coefficient which is larger than 1, and the invention is characterized in that in the vicinity of the surface where the secondary electrons are discharged, each channel comprises a curved portion, the distance between the said output surface and the curved channel portion amounting to a few times the diameter of the channel.

The invention proposes a method of manufacturing this type of microchannel or this type of microchannel plate by exerting a mechanical force on the input and output surfaces of the microchannel plate, while inside the channels such a temperature gradient prevails that the glass is in a state between the viscous state and the elastic state in the vicinity of the area where the said curved channel portions are to be formed.

According to the invention, the microchannel plate thus formed serves for the construction of electron sources which are controlled by means of low electrical voltages and which form part of electron tubes, for example, image intensifier tubes for the examination of rapidly occurring phenomena, or television camera tubes whose screen is scanned by a beam of slow electrons emitted by such a source.

The invention will be described in detail hereinafter with reference to the figures.

Figure 5:
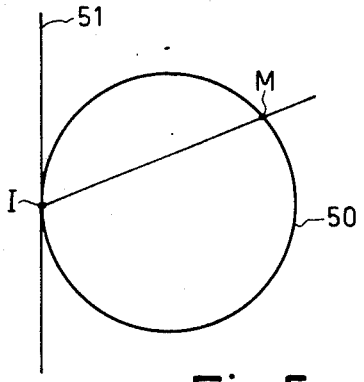
Figure 6:
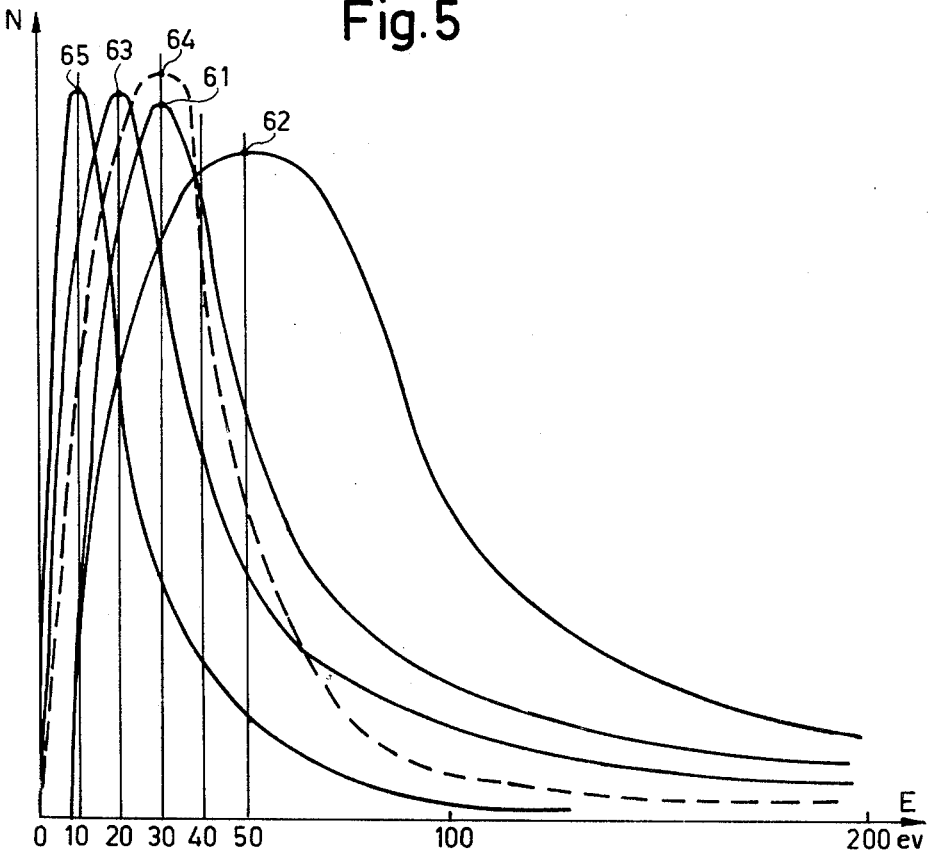
Figure 7:
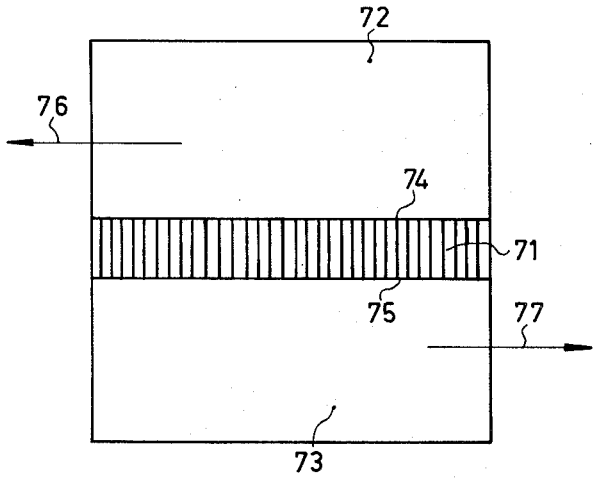
Figure 8:
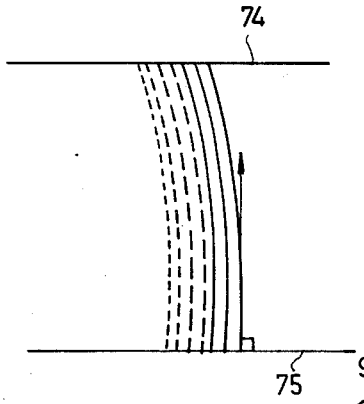
Figure 9:
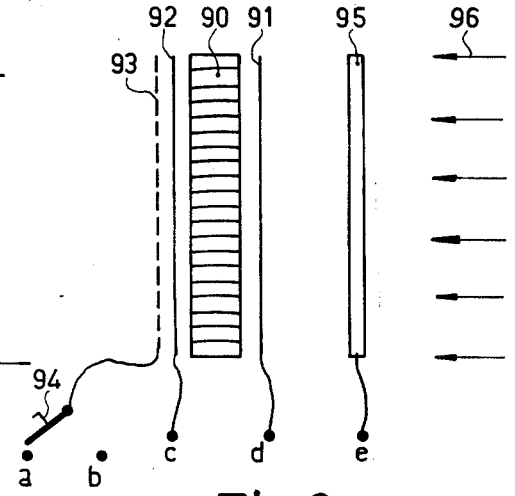
Figure 10:
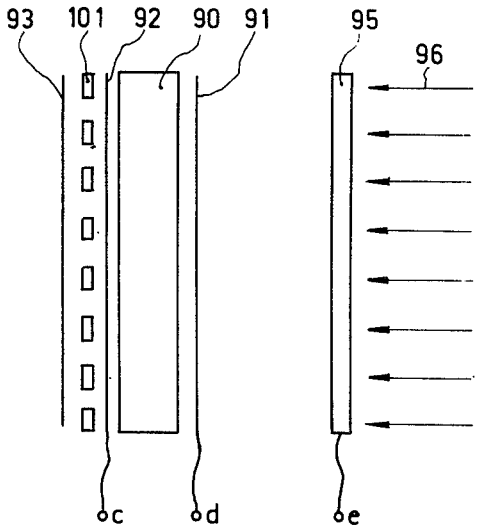
Figure 11:
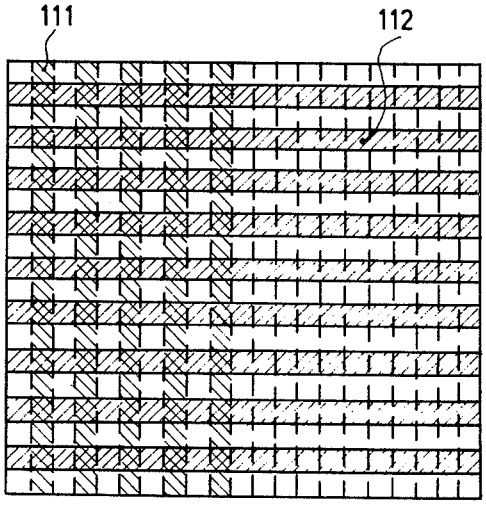
Figure 12:
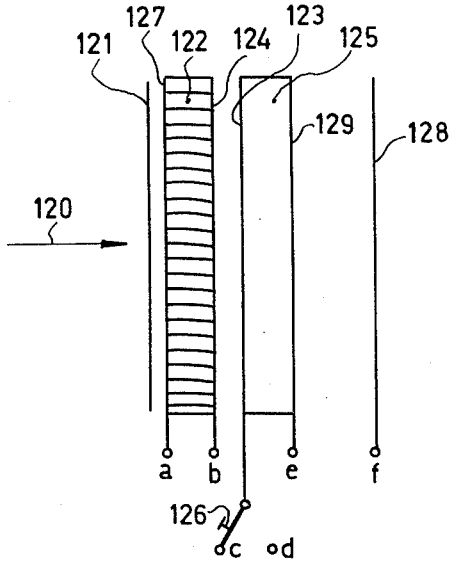
Figure 13:
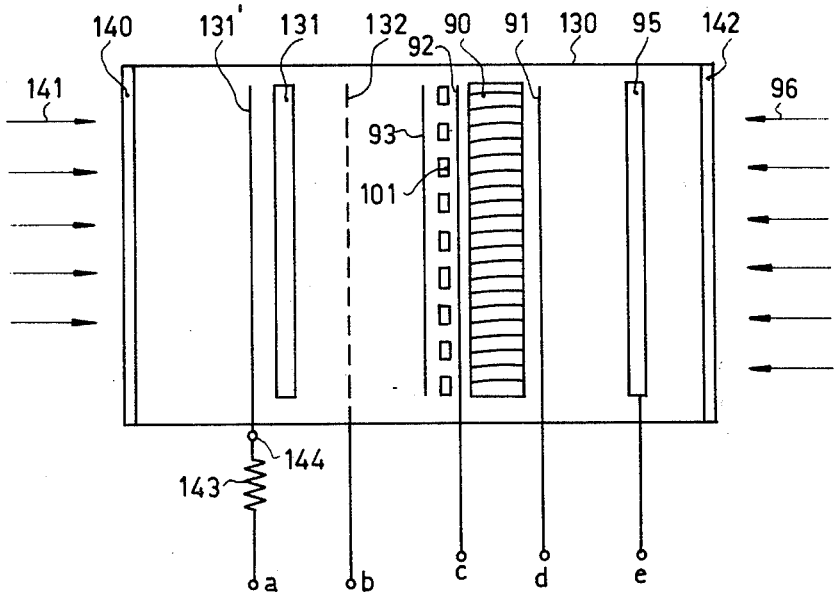

FIG. 5 shows the line of emission of secondary electrons after the collision with an emissive surface, FIG. 6 shows the distribution of the electrons as a function of the energy level thereof at the output of the microchannel plate after the collision according to FIG. 5, FIG. 7 shows the principle for bending the channel portions near the output surface of a microchannel plate, FIG. 8 shows the profile of the microchannels during the performance of the said method, FIG. 9 shows an electron source which is controlled by means of low electrical voltages, FIG. 10 shows an electron source which is locally controlled near the surface, FIG. 11 is a front view of the control electrodes of the source shown in FIG. 10, FIG. 12 shows an image intensifier for radioscopic purposes, FIG. 13 shows a vidicon tube which is provided with the necessary elements so as to be subjected to the scanning by an electron source of the type shown in FIG. 9.

Figure 1:
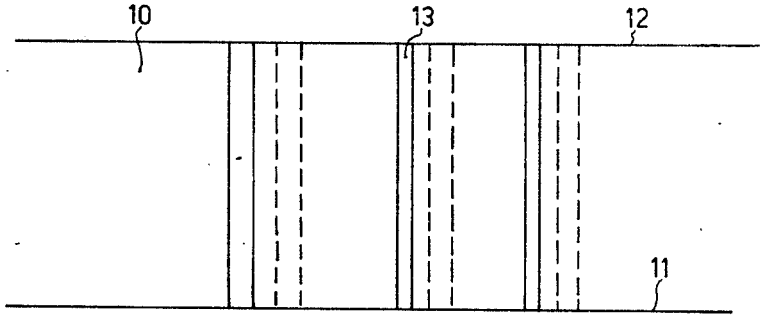
FIG. 1 shows a straight microchannel plate for secondary emission according to the known technique.

FIG. 1 shows a microchannel plate 10 comprising straight microchannels which are shown in a cross-section according to a plane parallel to these microchannels. For the sake of clarity, the drawing shows only a few microchannels. The input surface of the channels is denoted by the reference 11, and the output surface by the reference 12.

Figure 2:
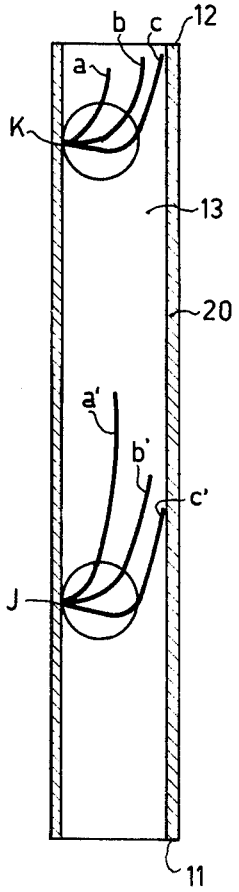
FIG. 2 shows a straight microchannel in which electrons are incident on the wall of the channel, the trajects followed by the secondary electrons also being indicated.

FIG. 2 separately shows the microchannel 13 of the microchannel plate 10 at an increased scale. The wall of the channel is denoted by the reference 20.

Figure 3:
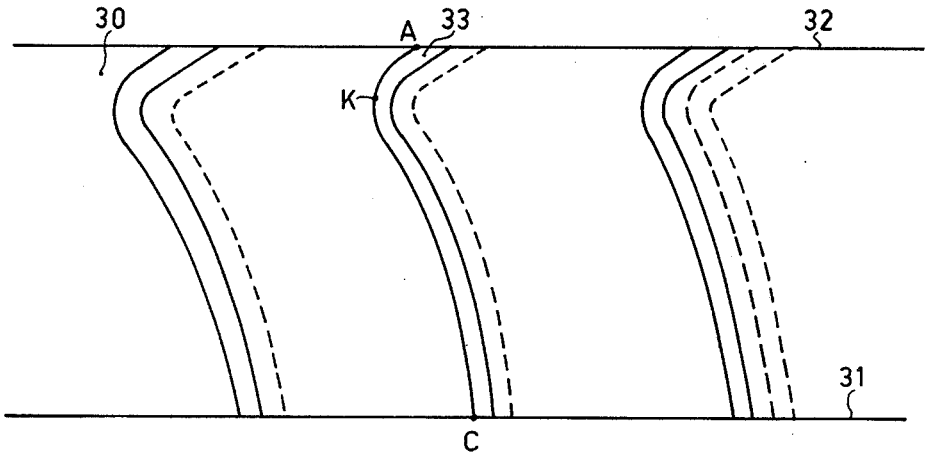
FIG. 3 shows a microchannel plate according to the invention, i.e. a plate whose microchannels comprise a curved portion near the output surface of the plate.

The reference 30 in FIG. 3 denotes the same channel plate as FIG. 1, but the microchannels are now strongly bent near the output surface of the plate, the input and output surfaces being denoted by the references 31 and 32, respectively. Each microchannel, for example, the microchannel 33, comprises on the one side a portion AK of small length which is situated near the output surface 32, and on the other side a portion KC which is longer and which opens into the input surface 31. In the present case, the portion AK may be straight or slightly curved; this may also be the case for the channel portion KC. The said channel portions AK and KC together constitutes a curved portion in the vicinity of the point K. The channel 33 is shown at an increased scale in FIG. 4.

For a proper understanding of the importance of such a curved channel portion and the operation of the microchannels of the plate 30, first the FIGS. 5 and 6 should be studied. These figures show the general results as regards the secondary emission of electrons by an emissive surface due to the collision of an electron with said surface.

FIG. 5 shows the line of secondary emission of electrons in the shape of a circle of an emissive surface as a function of the emission angle due to collision of electrons with the said emissive surface.

FIG. 6 illustrates inter alia the energy distribution of the secondary electrons emitted after the said collision.

The reference 51 in FIG. 5 denotes the path in the plane of the drawing of a surface which emits secondary electrons and which is assumed, for example, to be perpendicular to the plane of the drawing. The reference 50 in the plane of the drawing denotes the emission line of the said surface after the incidence of electrons at the point I. The quantity of electrons emitted in the direction of the straight line portion IM is proportional to the length of this line portion, independent of the location of the point M on the emission line. For a better understanding of the continuation of the description, it is to be noted that the secondary emission is maximum according to the normal to the surface.

FIG. 6 relates to the energy distribution of the secondary electrons emitted after the said collision. The energy of the electrons, denoted in electron volts (eV), is plotted along the horizontal axis, and the number of electrons plotted along the vertical axis (at an arbitrary scale).

The curve 63 has a Maxwellian shape and a maximum which is situated at approximately 20 eV, but exhibits pronounced probability of emission of secondary electrons having energy levels of between 20 eV on the one side and 100 to 200 eV on the other side.

In FIG. 2 the locations of incidence of the electrons in the interior of the straight channel 13 were considered; in the vicinity of the output surface 12 one of the electrons impinges at point K which is situated at a distance from the said output surface which equals, for example, the diameter of the channel, whilst the other electron is incident in the point J which is situated at a large distance from the output surface, this distance amounting, for example, to 20 times the diameter of the channel. In the said points K and J the secondary emission lines are shown. For each of these points three types of electron trajects can be considered, i.e. the types *a*, *b*, *c*, and *a'*, *b'*, *c'*.

The secondary emission angle, characterized by the angle between the initial direction of the electron and the line KJ, is smaller than 90° for the group *a*, *a'*, equal to 90° for the group *b*, *b'*, and larger than 90° for the group *c*, *c'*.

Due to the combined effect of the initial speed and of the electrical field in the channel, the concave portion of the electronic trajects is directed towards the wall side from which the electrons were emitted.

The probability that a secondary electron collides with the wall is high as the emission angle is larger and as the area where the electron is incident is situated deeper into the channel.

It may thus be stated that near the output surface of the microchannel plate the electrons emitted after impinging in the point K will probably give rise to collisions with the walls to only a limited extent because the trajects are elongate.

The contribution of these electrons to the spectrum of the energy of the electrons departing from the channel is identical, as regards the distribution, to the distribution denoted by the curve 61 of FIG. 6, a maximum being in the order of 30 eV.

However, as regards the locations of incidence which are situated deeper into the channel, it may be stated that the probability of a future collision with the wall is maximum for the electrons whose trajects belong to the type *b'* and *c'*, whilst this probability is small for the electrons whose trajects belong to the type *a'*. The latter electrons thus depart directly from the channel and have energy levels which are proportional to the potential difference between the point J and the output surface of the channel. These energy levels may be as high as several hundreds of eV, and will be higher as the distance between the locations of incidence and the output surface of the channel is larger.

As a result, the spectrum of the electrons departing from the microchannel is formed by the combination of, on the one hand, the spectrum of the electrons having a low energy which corresponds to locations of incidence which are situated in the vicinity of the output surface, the said spectrum being denoted by the curve 61 and, on the other hand, the spectrum of the electrons which originate from locations of incidence which are situated at a large disrance from the output surface, the latter spectrum being represented, for example, by the curve 62 in FIG. 6 and corresponding to the case of a microchannel plate having a thickness of 2.5 mm and being controlled by means of an electrical voltage of 1000 volts applied between the principal surfaces of the plate.

The contribution made to this spectrum by the electrons originating from locations of incidence which are situated at a large distance from the output surface (deep locations of incidence) is such that, on the one hand, the maximum emission is raised, for example, from 30 eV (curve 61) to, for example, 50 eV (curve 62) and, on the other hand, that the spectrum is even wider.

The invention has for its object to minimize and even to suppress the contribution made by the deep locations of incidence to the formation of the energy spectrum of the electrons departing from the output surface of the channel in a manner such that this spectrum is still centered at a comparatively weak energy in the order of, for example 30 eV, the width of this spectrum, at half height around said value, being reduced to approximately 15 eV. This spectrum is denoted by the curve 64 in FIG. 6.

Figure 4:
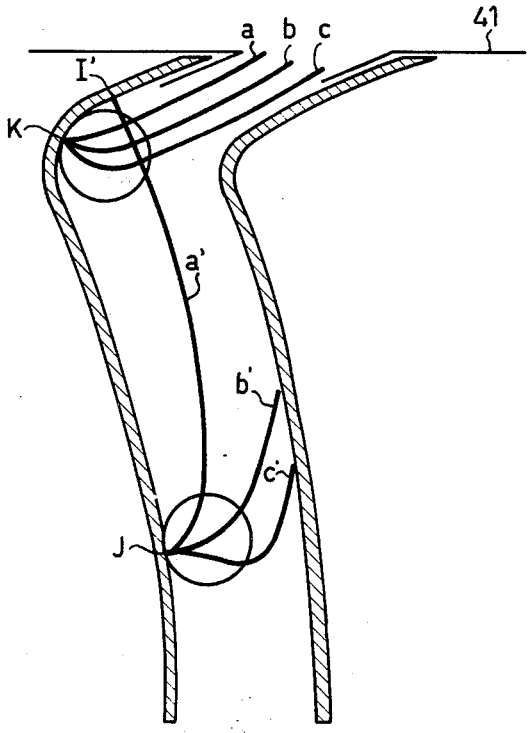
FIG. 4 shows a channel which comprises a curved portion and in which electrons collide with the wall; the trajects followed by the secondary electrons are also indicated.

This is achieved by substantially bending each microchannel of the plate near its output in order to impart a geometry thereto which is curved at the point K as shown in FIG. 4. In this figure the points K and J of FIG. 2 are again denoted, like the emission lines which are characteristic of the secondary emission in these points. As regards the electrons whose trajects are *a*, *b*, *c* and *b'*, *c'*, nothing has changed concerning the probability of later locations of incidence, but the curved portion of each microchannel forces the electrons incident in the point I' to complete trajects of the type *a'*.

The point J was chosen to be situated on the left-hand side of the wall; it is obvious that instead the said point J may be situated on the right-hand side, and that the consequences of the presence of the curved channel portion would then be the same for the trajects of the type a'.

It can thus be established that the electrons present at the output surface originate from locations of incidence which are concentrated in a wall zone of small surface area which is situated in the vicinity of the point K, that is to say that this point performs the function of a discrete dynode.

The secondary emission spectrum at the output of the channel is no longer influenced by secondary electrons originating from deep locations of incidence and having high energy levels, and thus exhibits the physionomy of a dynode spectrum conforming to the spectrum represented by the curve 64.

A second step according to the invention relates to a further decrease of the energy levels of the output electrons, and also to the reduction of the width of the spectrum of these energies. To this end, the metallization 41 of the output surface of the microchannel plate extends into the interior of the microchannels such that the potential of the point K' amounts to, for example, −10 volts with respect to the output surface. The said metallization causes the electrical field to be cancelled beyond the last location of incidence of the electrons during the multiplication, and hence a reduction of the energies of the output electrons, the spectrum thereof then being approximately as represented by the curve 65.

A further consequence of the structure of the microchannels according to the invention relates to the occurrence of the saturation region. Due to the fact that the collisions which occur in time near the end of the multiplication are localized around the point K, in the vicinity of this point the positive space and wall charges develop which causes the saturation region. The said localization results in the saturation region being obtained as a function of the supply voltage of the microchannels for voltage values which are smaller than in the case where the locations of incidence are spread over a large surface area near the output.

During tests it was established that for a thickness of the microchannel plate of 2.5 mm, the saturation region requires a voltage which is 200 volts lower, i.e. the voltage could be reduced from 1500 volts to 1300 volts. This comparatively low voltage offers the advantage that the emission of parasitic electrons caused by the field effect is limited.

The method according to the invention for obtaining microchannels and microchannel plates as described above, constitutes an improvement of the method described in the said French Patent Application No. 2,168,861. The solution proposed in this Application consists in exerting mechanical force on a microchannel plate, the direction of the said mechanical force being inclined with respect to the surfaces of the microchannel plate, whilst the surfaces in the interior of this plate which are parallel to the said input and output surfaces are isothermal surfaces, the temperature gradient in the direction perpendicular to the surfaces of the microchannel plate being non-uniform over at least a portion of the thickness of the said microchannel plate; in the said thickness portion this gradient is such that the glass is in a state between the viscous state and the elastic state.

The said Patent Application precisizes the application of the mechanical force by means of a body which consists of two portions which can be shifted with respect to each other, each portion being in contact with one of the principal surfaces of the microchannel plate.

According to one embodiment of the method corresponding to the said French Patent Application and taken as an example in order to illustrate the improvement realized according to the present invention, a block of rigid material is connected to each of the principal surfaces of the microchannel plate by welding, the softening temperature of the said block being higher than the temperature at which the glass is in a state between the viscous state and the elastic state.

The assembly thus formed is diagrammatically shown in FIG. 7. The microchannel plate is denoted by the reference 71, and the references 72 and 73 denote the blocks welded to the surfaces 74 and 75. The shearing forces exerted on the two blocks 72 and 73 are denoted by the references 76 and 77.

According to the present invention, besides a shearing force exerted in a given sense, a shearing force in the other sense is exerted, and vice versa.

For example, during a first phase of the process the temperature is increased from the surface 75 to the surface 74, the temperature at the surface 75 being approximately equal to the upper tempering temperature of the glass, and the temperature at the surface 74 lies between the tempering temperature and the softening temperature of the glass.

Under the influence of the said forces 76 and 77, the microchannels are slightly bent as shown in FIG. 8, the said channels remaining normally directed to the surface 75. Subsequently, the assembly thus obtained is uniformly cooled, and whilst the temperature of the glass is kept at a value between the upper tempering temperature and the softening temperature of the glass only in the vicinity of the surface 74, so that the glass is capable of undergoing permanent deformation, the forces 77 and 76 are applied in the other sense. The microchannels are then slightly bent in the vicinity of the surface 74 so as to obtain a curved portion as shown in FIG. 3 (point K of the channel 33), the reversal of the sense of the curvature, due to the reversal of the sense of the applied forces, being an important factor in the formation of the said curved portion.

According to the invention, a microchannel plate as described can be used in all sorts of channel intensifiers having reduced output dispersion.

The large numbers of applications of the said microchannel plate is justified by the fact that such a channel plate constitutes an electron source having large surfaces, the said electrons having energy levels which are low and hardly subject to dispersion, whilst the emission of the said electrons can be readily controlled by means of low electrical voltages which can thus be readily switched from one value to the other.

A first embodiment of such an electron source is shown in FIG. 9. A microchannel plate comprising curved microchannels is denoted by the reference 90. The references 91 and 92 denote the metallizations of the input and output surfaces of the said plate 90, respectively. The reference 93 denotes a fine-mesh grid which is arranged in front of and in the immediate vicinity of the metallization 92, the said grid being isolated with respect thereto.

The grid 93 is electrically connected to the switch 94, the movable contact of which can be connected to the terminal *a* or to the terminal *b*.

Electrons are emitted on the input electrode 91 of the microchannel plate. The said electrons originates from a photocathode which is subjected to the influence of the light beam 96. Obviously, the electrons can alternatively be applied to the microchannel plate via any other suitable means.

These various electrodes and elements are separately connected to the terminals *a*, *b*, *c*, *d* and *e*, on which electrical potentials prevail.

For example, the terminals *c* is connected to earth, the terminal *d* carries a voltage of −1000 volts, the terminal *e* carries a voltage of −1300 volts, whilst the terminal *a* is connected to earth, and the terminal *b* carries a voltage of −40 volts. When the contact of the switch 94 contacts the terminal *a*, the electrons emitted by the microchannel plate pass through the grid 93. However, when the contact of the switch 94 contacts the terminal *b*, the electrons emitted by the microchannel plate are arrested by the grid 93 because the energy levels of the said electrons amount to approximately 30 eV.

In a second embodiment of the electron source according to the invention, as shown in FIG. 10, the electron emission is controlled as a function of the emission point of the output surface.

To this end, the electrode 93 is divided into parallel, vertical strips which are insulated with respect to each other. On the other side, an electrode 101, for example, divided into horizontal strips, is arranged between the electrode 93 and the electrode 92. FIG. 11 shows this new electrode in a front view; a vertical strip is denoted as 111, whilst the horizontal strip is denoted as 112. Switching systems (not shown and serving to connect the strips to potential sources) are arranged such that given horizontal strips carry a voltage of, for example, −40 volts, whilst other horizontal strips are connected to earth; this is also applicable to the vertical strips of the electrode 93. Electron emission will occur according to the surface points of the microchannel plate which are covered by the horizontal strip and the vertical strip at earth potential. Electron emission can thus be obtained which develops in time according to a horizontal strip which is the only horizontal strip connected to earth, whilst the potential of the vertical strips, initially amounting to −40 volts, is briefly changed to earth potential one strip after the other.

According to the invention, electron sources of this kind are incorporated in electronic devices, examples of which are described hereinafter.

The first example concerns a device which can be used for the visual examination of a phenomenon, for example, a phenomenon which occurs in a plasma emitting X-rays. The problem to be solved is, for example, the examination of the said phenomenon during periods which are comparatively short with respect to duration of the phenomenon, it being possible for the said periods to be shifted from the beginning to the end of the phenomenon.

The device is diagrammatically shown in FIG. 12, and comprises a converter 121 which is, for example, a plate of gadolinium for converting an X120 beam into electrons. The energy of the electrons is substantially dispersed at the output of the said converter. It is a first function of the microchannel plate 122, the input and output surfaces of which are denoted by the references 127 and 124, to convert the said converter electrons of substantially dispersed energy into electrons of only slightly dispersed energy.

It is a second function of the microchannel plate to limit the dispersion in the direction of the electrons emitted by the converter; this is achieved in that the input of the microchannel plate is arranged in the immediate vicinity of the converter so as to reduce the dimensions of the target spot and to improve the resolution of the device. The electron emission at the output is blocked by an electrode 123 which has a potential which is, for example, 40 volts lower than the potential of the surface 124 of the microchannel plate 122.

This electrode is formed, for example, by the metallization of the input surface of a further microchannel plate 123, the output surface of which is denoted by the reference 129 and which is arranged parallel to the screen 128 and the microchannels 122 in the immediate vicinity of the latter.

The electron emission of the microchannel plate 122 is deblocked by the application of a positive voltage of, for example +60 volts between the electrode 124 and the electrode 123. This voltage is applied by means of a switch 126 which enables the electrode 123 to be connected to the terminal *c* or to the terminal *d*; one of these terminals carries the potential −40 volts and the other carries the potential +60 volts. The other elements and electrodes are connected to the terminals *a*, *b*, *e*, *f* which carry the potentials −300 volts, earth potential, +1000 volts, and +5000 volts respectively.

A second example of the incorporation of an electron source according to the invention in a known device is shown in FIG. 13. This figure concerns a television camera tube, the screen of which is scanned by an electron beam supplied by the said electron source.

Like in a conventional vidicon, the interior of the vacuum space 130 comprises from left to right a photoconductive layer 131, having a high electrical resistance in the absence of light, for example, a selenium layer which is covered by a layer 131' of an electrically conductive material which is transparent to light and which is made, for example, of $Sno_2$, a grid 132 and an assembly which constitutes an electron source according to the invention and which resembles the source shown in FIG. 10; this source supplies a beam of slow electrons which scans the layer 131 one line after the other.

The vacuum space comprises two windows which transmit light, i.e. the window 140 for the beam 141 which originates from the image, and the window 142 for the beam 96 which originates from the electron source.

The transparent layer 131' has connected in series therewith an electrical resistor 143, the video signal being taken from the end 144 thereof.

The various elements and electrodes are connected to the terminals *a*, *b*, *c*, *d*, *e* which carry the various potentials, for example, −40 volts for the resistor 143, +300 volts for the grid 132, the earth potential for the metallization 92, −1000 volts for the metallization 91, and −1300 volts for the photocathode 95; the strips constituting the electrodes 93 and 101 are connected to earth potential and to the potential −40 volts as already described.

The operation of this tube is identical to that of the conventional vidicon tube, except for the fact that the scanning by way of electrons from the screen 131 is performed from the slow electron source according to the invention; the device comprises means (not shown) for connecting the strips of the electrodes 101 and 93 to terminals carrying the potentials −40 volts and earth potential.

What is claimed is:

1. A secondary-emissive microchannel plate comprising a plurality of substantially identical parallel aligned microchannels having inner walls which are both secondary-emissive and electrically resistive for electron multiplication, each microchannel having an axis which at most curves only slightly except in the vicinity of a point positioned from the output of said microchannel by a distance equal to a few times the diameter of said microchannel, said axis curving sharply in the vicinity of said point to cause substantially all electrons travelling along said microchannel to make a final collision with the wall of said microchannel in the vicinity of said point, the inner wall surfaces of said microchannels being conductive adjacent to the output thereof, whereby is reduced the energy dispersion of exiting secondary electrons.

* * * * *

UNITED STATES PATENT AND TRADEMARK OFFICE

CERTIFICATE OF CORRECTION

PATENT NO. : 4025813

DATED : May 24, 1977

INVENTOR(S) : GILBERT ESCHARD ET AL

It is certified that error appears in the above-identified patent and that said Letters Patent are hereby corrected as shown below:

Claim 1, line 15, delete "is reduced";

line 16, after "electrons" insert --is reduced--.

Signed and Sealed this

*Twentieth* Day of *September 197*

[SEAL]

*Attest:*

RUTH C. MASON
*Attesting Officer*

LUTRELLE F. PARKER
*Acting Commissioner of Patents and Trademark*